US009284617B2

(12) United States Patent
Mol de Oliveira et al.

(10) Patent No.: US 9,284,617 B2
(45) **Date of Patent: *Mar. 15, 2016**

(54) METHOD TO OBTAIN A HIGH RESISTANCE GRAY IRON ALLOY FOR COMBUSTION ENGINES AND GENERAL CASTS

(75) Inventors: Otto Luciano Mol de Oliveira, Betim-MG (BR); Jefferson Pinto Villafort, Betim-MG (BR)

(73) Assignee: TEKSID DO BRASIL LTDA., Municipio de Detim/MG (BR)

( * ) Notice: Subject to any disclaimer, the term of this patent is extended or adjusted under 35 U.S.C. 154(b) by 1224 days.

This patent is subject to a terminal disclaimer.

(21) Appl. No.: 13/201,300

(22) PCT Filed: Feb. 12, 2009

(86) PCT No.: PCT/BR2009/000044

§ 371 (c)(1),
(2), (4) Date: Nov. 18, 2011

(87) PCT Pub. No.: WO2010/091486

PCT Pub. Date: Aug. 19, 2010

(65) Prior Publication Data

US 2012/0087824 A1 Apr. 12, 2012

(51) Int. Cl.

| | |
|---|---|
| ***C21C 1/00*** | (2006.01) |
| ***C21C 1/08*** | (2006.01) |
| ***C21C 1/10*** | (2006.01) |
| *C22C 37/10* | (2006.01) |

(Continued)

(52) U.S. Cl.
CPC ... *C21C 1/08* (2013.01); *C21C 1/10* (2013.01); *C21C 1/105* (2013.01); *C22C 37/00* (2013.01); *C22C 37/06* (2013.01); *C22C 37/10* (2013.01)

(58) Field of Classification Search
CPC ..... C21C 1/00; C21C 1/02; C21C 1/04; C21C 1/08; C21C 1/10; C21C 1/105; C22C 37/00; C22C 37/04; C22C 37/06; C22C 37/08; C22C 37/10; C22C 33/08; C22C 33/10; C22C 33/12; C22C 38/00; C22C 38/001; C22C 38/002; C22C 38/005; C22C 3/02
See application file for complete search history.

(56) References Cited

U.S. PATENT DOCUMENTS 3,467,167 A * 9/1969 Mahin ..... 164/473
3,492,118 A * 1/1970 Mickelson ..... 420/30

(Continued)

FOREIGN PATENT DOCUMENTS

EP 0616040 9/1994
FR 1 466 328 1/1967

(Continued)

OTHER PUBLICATIONS

Riposan, I., et al. "Al, Zr—FeSi preconditioning of grey cast irons." Materials Science and Technology 24.5 (2008): 579-584.*

(Continued)

*Primary Examiner* — Roy King
*Assistant Examiner* — Jophy S Koshy
(74) *Attorney, Agent, or Firm* — Volpe and Koenig, P.C.

(57) ABSTRACT

A new alloy, obtained through a new method, which presents the mechanical and physical properties of the gray iron alloy, with a wide interface range of the CGI's tensile strength (TS). This new alloy, flake graphite based, is a High Performance Iron (HPI) alloy. Therefore, besides its high tensile strength, the HPI alloy presents excellent machinability, damping vibration, thermal conductivity, low shrink tendency and good microstructure stability (compatible with gray iron alloys). HPI's characteristics are obtained by a method that defines a specific interaction among five metallurgical fundaments: chemical analysis; oxidation of the liquid metal; nucleation of the liquid metal; eutectic solidification and eutectoidic solidification.

1 Claim, 4 Drawing Sheets

(51) Int. Cl.
*C22C 37/06* (2006.01)
*C22C 37/00* (2006.01)

(56) References Cited

U.S. PATENT DOCUMENTS

| | | | | |
|---|---|---|---|---|
| 4,401,469 | A | 8/1983 | Rehder | |
| 7,419,554 | B2 * | 9/2008 | Eriksson et al. | 148/321 |
| 2008/0206584 | A1 * | 8/2008 | Jaszarowski et al. | 428/544 |

FOREIGN PATENT DOCUMENTS

| | | |
|---|---|---|
| JP | 60 052516 | 3/1985 |
| JP | 10 096040 | 4/1998 |
| WO | 2004/083474 A1 | 9/2004 |
| WO | 2004083474 | 9/2004 |

OTHER PUBLICATIONS

Collini et al., "Microstructure and mechanical properties of pearlitic gray cast iron," Material Sciences and Engineering A 488 (2008) 529-539.

Erich Pirweck, "Technologien und Gütemaβstäbe für die Bewertung von Guβeisen mit Lamellengrphit," copyright Friedr. Vieweg & Sohn 1983.

* cited by examiner

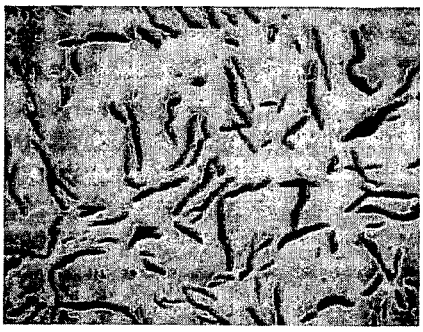
Figure 1 (X100)
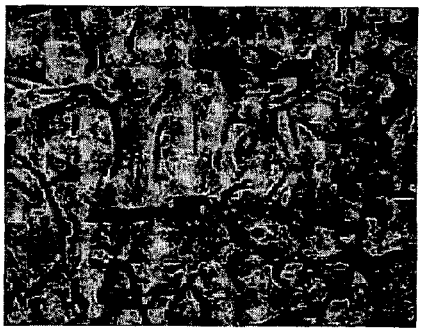
Figure 2 (X100)
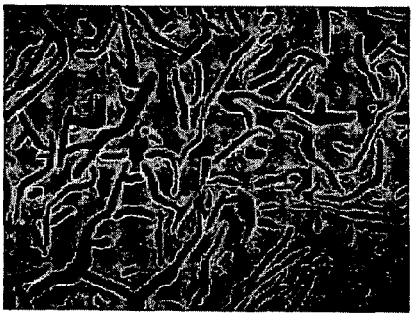
Figure 3 (X100)
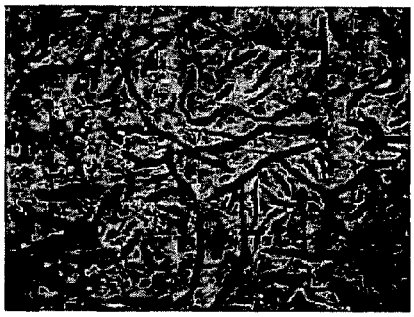
Figure 4 (X100)
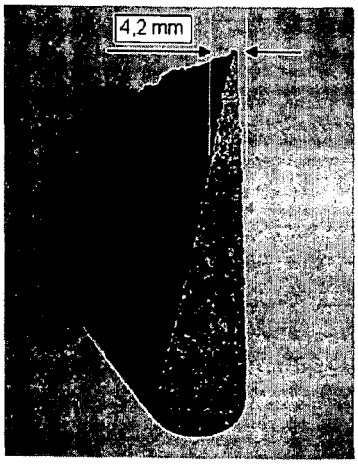
Figure 5
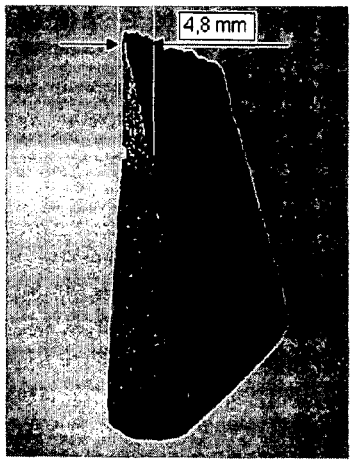
Figure 6

METHOD TO OBTAIN A HIGH RESISTANCE GRAY IRON ALLOY FOR COMBUSTION ENGINES AND GENERAL CASTS

BACKGROUND OF THE INVENTION

The present invention defines a new class of gray iron alloy, produced by a new method to obtain higher tensile strength, while keeping the machinability conditions compatible with traditional gray iron alloys. More specifically, the material produced by this method can be used either in combustion engines with high compression rates, or in general casts and traditional combustion engines where weight reduction is a target.

FIELD OF THE INVENTION

Gray iron alloys, known since the end of XIX century, have become an absolute success in the automotive industry due to their outstanding properties, mainly required by combustion engines. Some of these gray iron alloy characteristics have been recognized for a long time as presenting:

Excellent thermal conductivity

Excellent damping vibration capacity

Excellent machinability level

Relatively small shrink rate (low tendency for internal porosities on the casts)

Good thermal fatigue level (when using a Molybdenum based alloy)

However, due to the increasing requirements of combustion engines such as more power, lower fuel consumption and lower emissions for environmental purposes, the traditional gray iron alloys hardly achieve the minimum tensile strength required by combustion engines with higher compression rates. Generally, as a simple reference, such tensile strength requirements start at a minimum 300 MPa, at main bearing location on cylinder blocks or at fire face location on cylinder heads.

Precisely the big limitation of the current gray iron alloys is that they present a drastic decrease of machinability properties when higher tension is required.

DESCRIPTION OF RELATED ART

Thus, in order to solve such problem, some metallurgists and material experts decided to focus on a different alloy: compact graphite based, usually known as compact graphite iron (CGI). Many papers discuss the CGI properties:

R. D. Grffin, H. G. Li, E. Eleftheriou, C. E. Bates, "Machinability of Gray Cast Iron". Atlas Foundry Company (Reprinted with permission from AFS)

F. Koppka e A. Ellermeier, "O Ferro Fundido de Grafita Vermicular ajuda a dominar altas pressões de combustão", Revista M M, January/2005.

Marquard, R & Sorger, H. "Modern Engine Design". CGI Design and Machining Workshop, Sintercast—PTW Darmstadt, Bad Homburg, Germany, November 1997.

Palmer, K. B. "Mechanical properties of compacted graphite iron". BCIRA Report 1213, pp 31-37, 1976

ASM. Speciality handbook: cast irons. United States: ASM International, 1996, p. 33-267.

Dawson, Steve et al. The effect of metallurgical variables on the machinability of compacted graphite iron. In: Design and Machining Workshop—CGI, 1999.

Indeed, several Patents applications have been required regarding CGI process:

U.S. Pat. No. 4,667,725 of May 26, 1987 in the name of Sinter-Cast AB (Viken, S E). A method for producing castings from cast-iron containing structure-modifying additives. A sample from a bath of molten iron is permitted to solidify during 0.5 to 10 minutes.

WO9206809 (A1) of Apr. 30, 1992 in the name of SINTER-CAST LTD. A method for controlling and correcting the composition of cast iron melt and securing the necessary amount of structure modifying agent.

Although the CGI alloy presents outstanding tensile strength, it also presents other serious limitations regarding its properties or industrialization. Among such limitations, we can emphasize:

Lower thermal conductivity;

Lower damping vibration capacity;

Lower machinability level (hence, higher machining costs);

Higher shrink rate (hence, higher tendency for internal porosities); and

Lower microstructure stability (strongly dependent on the cast wall thickness).

In this scenario, the challenge was to create an alloy that keeps the similar outstanding properties of the gray iron alloy, concomitantly with a wide tensile strength interface of the CGI alloy. This is the scope of the present invention.

Currently, the method to obtain a gray iron cast, in the foundries, has the following steps:

Melting Phase: the load (scraps, pig iron, steel, etc) is melted by cupola, induction or arc furnaces.

Chemical Balance: usually performed on the liquid batch inside the induction furnace, in order to adjust the chemical elements (C, Si, Mn, Cu, S, etc) according to the required specification.

Inoculation Phase: commonly carried out at the pouring ladle or at the pouring mold operation (when using pouring furnaces), in order to promote enough nucleus to avoid the undesirable carbide formation.

Pouring Phase: carried out on the molding line at a pouring temperature usually defined in a range to prevent blow holes, burn in sand and shrinkage after the cast solidification. In other words, the pouring temperature is actually defined as a function of the cast material soundness.

Shake-Out Phase: usually performed when the cast temperature, inside the mold, cools comfortably under the eutectoidic temperature (≈700° C.).

Such a process is applied at foundries worldwide and has been the object of many books, papers and technical articles:

Gray Iron Founders' Society: Casting Design, Volume II: Taking Advantage of the Experience of Patternmaker and Foundryman to Simplify the Designing of Castings, Cleveland, 1962.

Straight Line to Production: The Eight Casting Processes Used to Produce Gray Iron Castings, Cleveland, 1962. Henderson, G. E. and Roberts, Metals Handbook, 8th Edition, Vols 1, 2, and 5, published by the American Society for Metals, Metals Park, Ohio.

Gray & Ductile iron Castings Handbook (1971) published by Gray and Ductile Iron Founders Society, Cleveland, Ohio.

Gray. Ductile and Malleable, Iron Castings Current Capabilities. ASTM STP 455, (1969)

Ferrous Materials: Steel and Cast Iron by Hans Berns, Werner Theisen, G. Scheibelein, Springer; 1 edition (Oct. 24, 2008)

Microstructure of Steels and Cast Irons Madeleine Durand-Charre Springer; 1 edition (Apr. 15, 2004)

Cast Irons (Asm Specialty Handbook) ASM International (Sep. 1, 1996).

Many patent applications reveal compositions with the usual components on gray iron alloys, also applied to the present application. However, comparing to our application, they not present all the components and/or equations that are mandatory to regulate the precise balance between some specifics components in the final composition.

Examples of that is the PCT application WO 2004/083474 of a Volvo composition with the mandatory presence of N in its composition (not applied in our application) or the Japanese application JP 10096040 with the requirement of Ca in its composition (not applied in the present invention). Besides, it is important to inform that the composition of those applications defines ranges of variations in several components that are too wide. If applied in the present invention would deteriorate the main material properties.

Other example is the European Patent EP 0616040 for the desulphurization of a gray cast alloy. In this European application the component "S" must be eliminated. Differently, the present invention requires the "S" component as important factor to generate the necessary nucleus.

BRIEF DESCRIPTION OF THE DRAWINGS

The present application will be explained based on the following non limitative figures:

FIGS. 1 and 2 show the microstructure (unetched and etched) of the HPI alloy;

FIGS. 3 and 4 show the microstructure (unetched and etched) of the traditional gray iron alloy;

FIG. 5 shows a chill test probe before deoxidation process;

FIG. 6 shows a chill test probe after the deoxidation process;

DETAILED DESCRIPTION OF THE INVENTION

Figure 7:
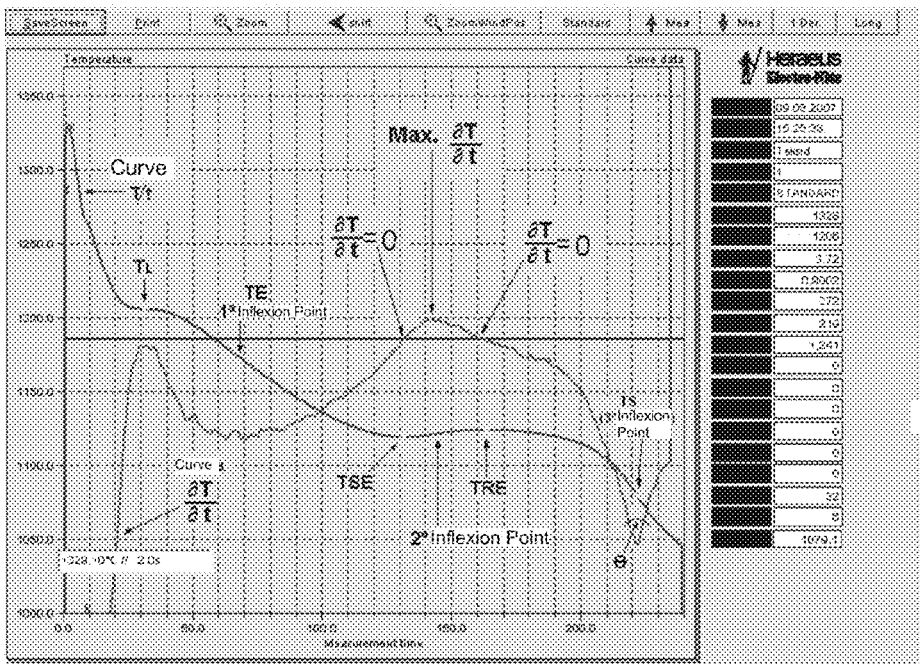
FIG. 7 shows a cooling curve and its derivative for the HPI alloy.

The present invention defines a method to obtain a new alloy, flake graphite based, with the same excellent industrial properties of the traditional gray iron, with higher tensile strength (up to 370 Mpa), which makes this alloy an advantageous alternative if compared with the CGI alloy.

By analytical and practical means, said method can promote an interaction among five metallurgical fundaments: chemical analysis; oxidation level of the liquid batch; nucleation level of the liquid batch; eutectic solidification and eutectoidic solidification. The present method allows the obtainment of the best condition from each one of these fundaments in order to produce this new high performance iron alloy, herein called HPI.

Chemical Analysis

The chemical correction is carried out in traditional ways, at the induction furnace and the chemical elements are the same ones already known by the market: C, Si, Mn, Cu, Sn, Cr, Mo, P and S.

However, the following criteria for the balance of some chemical elements must be kept so that the desirable flake graphite morphology (Type A, size 4 to 7, flakes with no sharp ends), the desirable microstructure matrix (100% pearlitic, max 2% carbides) and the desirable material properties can be obtained:

The carbon equivalent (CE) is defined in the range from 3.6% to 4.0% in weight but, at the same time, keeping the C content from 2.8% to 3.2%. The HPI alloy has a higher hypoeutectic tendency if compared with the traditional gray iron alloys.

The Cr content is defined as max 0.4% and, when associated with Mo, the following criterion must be obeyed: % Cr+% Mo≤0.65%. It will permit the proper pearlitic refinement.

The Cu and Sn must be associated according to the following criterion: 0.010%≤[% Cu/10+% Sn]≤0.021%

The S and Mn contents are defined in specific ranges of the rate % Mn/% S, calculated to guarantee that the equilibrium temperature of the manganese sulfide MnS will always occur under the "liquidus temperature" (preferable near the eutectic starting temperature). Besides improving the mechanical properties of the material, this criterion prompts the nucleus formation inside the liquid batch. Table 1 presents the application of such criterion for a diesel cylinder block where the % Mn was defined between 0.4% and 0.5%.

TABLE 1

| ideal "Mn/S" range, as a function of % Mn | |
|---|---|
| Mn = 0.40% | Ideal Range: Mn/S = 3.3 to 3.9 |
| Mn = 0.47% | Ideal Range: Mn/S = 4.0 to 5.0 |
| Mn = 0.50% | Ideal Range: Mn/S = 4.9 to 6.0 |

The Si content range is defined from 2.0% to 2.40%.

The "P" content is defined as: % P≤0.10%.

FIGS. 1, 2, 3 and 4 show the compared microstructure between traditional gray iron and HPI alloys, where the graphite morphology and graphite quantity spread in the matrix can be observed.

Oxidation of the Liquid Batch

To obtain the HPI alloy, the liquid batch in the induction furnace must be free of coalesced oxides that do not promote nucleus. Besides, they also must be homogeneous along the liquid batch. So, in order to meet such criterion, a process for deoxidation was developed according to the following steps:

Increase of the furnace temperature over the silicon dioxide (SiO2) equilibrium temperature (TE);

Turning off the furnace power for at least 5 minutes to promote the flotation of the coalesced oxides and other impurities;

Spreading of an agglutinating agent on the surface of the liquid batch; and

Removal of such agglutinant material now saturated with the coalesced oxides, leaving cleaner liquid metal inside the furnace.

Despite the fact that this operation decreases the nucleation level (see FIGS. 5 and 6 presenting the chill test probes, before and after the deoxidation process), said steps ensure that only active oxides, promoters of nucleus, remain in the liquid batch. Such operation also increases the effectiveness of the inoculants to be applied later.

Nucleation of the Liquid Batch

Another important characteristic of the HPI alloy when compared to the traditional gray iron alloys is precisely the elevated eutectic cell number. The HPI alloy presents from 20% to 100% more cells if compared with the same cast performed in current gray iron alloys. This higher cells number directly promotes smaller graphite size and, thus, contributes directly to the increase of the tensile strength of the HPI material. In addition, more cell number also implies more MnS formed in the very core of each nucleus. Such phenomenon is decisive to increase tool life when the HPI material is machined.

After the chemical correction and deoxidation process, the liquid batch inside the furnace must be nucleated according to the following method:

- Pouring from 15% to 30% of the furnace liquid batch on a specific ladle.
- During this operation, inoculating from 0.45% up to 0.60% in % weight of granulated Fe—Si—Sr or Fe—Si—Ba—La alloys, right on the liquid metal stream.
- Returning the inoculated liquid metal from the ladle to the furnace, keeping the operation with a strong metal flow.
- During such operation, the furnace must be kept on "turn on" phase.

Besides creating new nuclei, said method also increases the active oxides number in the liquid metal inside the furnace.

In sequence, the usual inoculation phase is performed in traditional ways, since long time known by the foundries. However, the difference for HPI alloy is precisely the range of % weight of inoculant applied on the pouring ladle or pouring furnace immediately before the pouring operation: From 0.45% to 0.60%. It represents about twice the % of inoculant currently applied in this step to perform traditional gray iron alloys.

The following step is to specify the nucleation of the liquid metal by thermal analysis. The objective of this application, defines two thermal parameters from the cooling curves as more effective to guarantee a desirable nucleation level:

1) Eutectic Under-Cooling Temperature "TSE" and
2) Range of Eutectic Recalescence Temperature "ΔT".

Both parameters must be considered together, to define whether the liquid metal is nucleated enough to be compatible with the HPI requirements.

The desirable nucleation of the HPI alloy must present the following values:

TSE: Min 1115° C.; and

ΔT: Max 6° C.

wherein, eutectic temperature undercooling, TSE, is greater than or equal to 1115° C. and range of eutectic recalescence, ΔT, has a maximum of 6° C., wherein TSE and ΔT are two thermal parameters from the cooling curves during nucleation.

FIG. 7 shows the cooling curve and its derivative from a diesel 6 cyl, cylinder block, cast with HPI alloy, where both thermal parameters are met as required by the criterion. Said block presented the tensile strength value of 362 MPa and hardness of 240 HB at bearing location.

Figure 8:
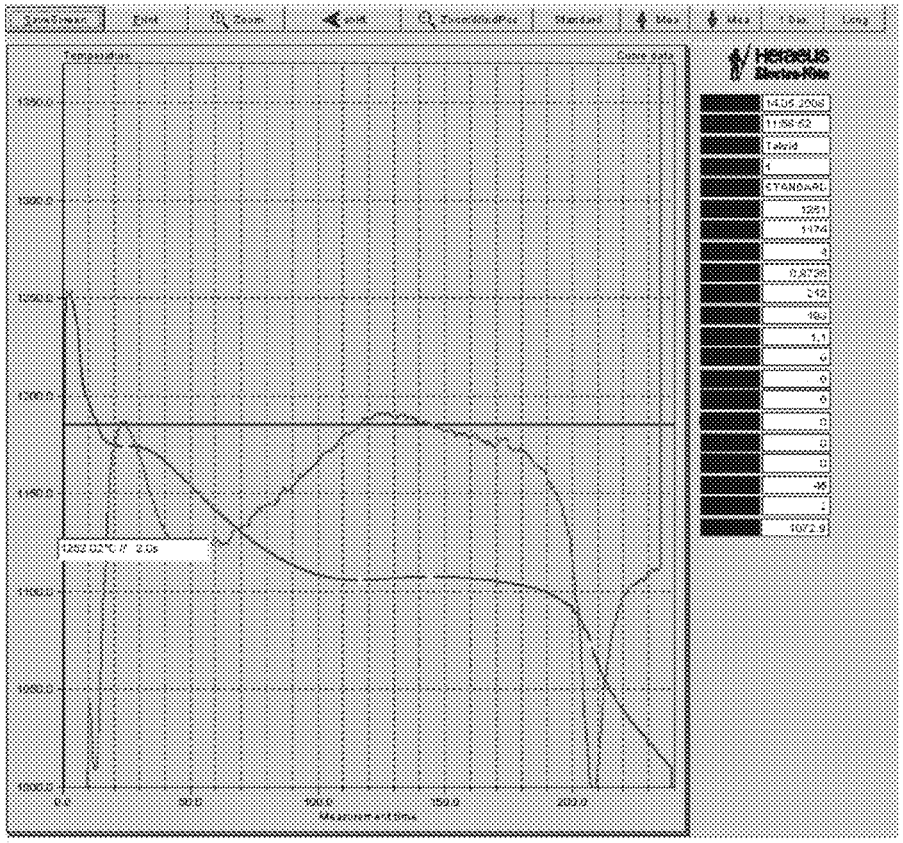
FIG. 8 shows a cooling curve and its derivative for the traditional gray iron alloy.

FIG. 8 shows the cooling curve of the same block, cast with normal gray iron, where the ΔT was found ≈2° C. (matching the HPI nucleation requirement), but the TSE value was 1105° C. (not matching the HPI nucleation requirement). This traditional gray iron block presented the tensile strength value of 249 MPa and hardness of 235 HB at bearing location.

As a reference, table 2 below presents the comparison of HPI thermal data using two different inoculants:

As a reference, Table 2 below presents the comparison of HPI thermal data using two different inoculants. Several thermal parameters can be seen in FIG. 7 where: TL is the "Liquidus" Temperature; TEE is Stable Eutectic Temperature; TE is Eutectic temperature; TSE is Eutectic Undercooling Temperature; TRE is the maximum Temperature of Eutectic Recalescence; ΔT is Temperature Range of Recalescence (ΔT=TRE-TSE); ΔSC is the range of temperature between TRE and TEE; ΔSN is the range of temperature between TSE and TEE; TS is the "Solidus" Temperature; θ is the angle of the derivative curve at "Solidus" Temperature (TS): Sharp means θ<90° (completed all the eutectic reactions); Max δT/δt is the max. punctual cooling speed during the eutectic reactions, measured by ° C./s: In Table 2, the comparison data of thermal analysis (° C.) is, as stated above, between two inoculants, Fe—Si alloy Ba—La based and Sr based.

TABLE 2

Comparison of HPI thermal data

| INOCULANT | TL (° C.) | TEE (° C.) | TE (° C.) | TSE (° C.) | TRE (° C.) | ΔT (° C.) | ΔSN | ΔSC (%) | TS (° C.) | θ | Max ∂T/∂t |
|---|---|---|---|---|---|---|---|---|---|---|---|
| FeSi—Ba—La | 1210 | 1156 | 1181 | 1115 | 1123 | 8 | 41 | 33 | 1081 | Sharp | (X/s) |
| FeSi—Sr | 1210 | 1156 | 1176 | 1119 | 1124 | 5 | 37 | 32 | 1079 | Sharp | (X/s) |

The cast applied with Ba—La inoculant presented Tensile Strength=346 MPa and 2% of carbides. On the other hand, the block applied with Sr inoculant presented Tensile Strength=361 MPa with no carbides. It shows the sensibility of the related thermal parameters on the nucleation level of the liquid batch.

Eutectic Solidification

As a remarkable solidification phenomenon, the eutectic phase represents the birth that characterizes the latter material properties. Many books and papers have approached the eutectic phase in many ways, signaling several parameters such as heat exchange between metal and mold, chemistry, graphite crystallization, recalescence, stable and meta-stable temperatures and so on.

However, the HPI alloy and its method, prescribe in the eutectic phase a specific interaction between two critical parameters directly related to the foundry process and to the cast geometry, as follows:

Pouring temperature "Tp"; and

Global solidification modulus of the cast "Mc".

Hence applying a specific calculation, the HPI method defines the global cast modulus "Mc", at the range: 1.38≤"Mc"≤1.52, as a function of the best calculated pouring temperature "Tp" (allowed+/−10° C.).

Such criterion allows effective speed for the eutectic cells to grow and achieve the desirable mechanical and physical properties besides drastically reduce the shrinkage formation when the HPI cast gets solid. In other words, this method requires a calculated pouring temperature as a function of the global cast modulus. It is quite different from the common practice where the pouring temperature is usually empirical in order to get the cast soundness.

Eutectoidic Solidification

Figure 10:
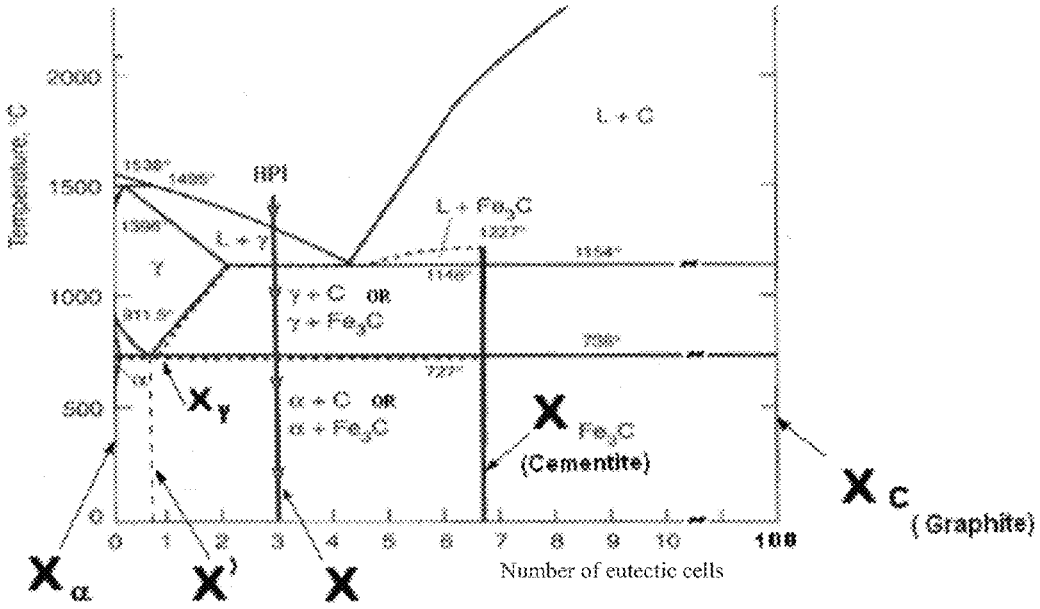
FIG. 10 shows an interfaced Fe—C and Fe—Fe3C equilibrium diagram: the thick line with arrows represents a stronger tendency in hypoeutectic level of the HPI alloy.

As a solid-solid transformation, the eutectoidic phase shapes the final microstructure of the cast. Then, despite being a flake graphite alloy, the HPI microstructure presents slightly reduced graphite content on its matrix: ≤2.3% (calculated by the "lever rule" taking as reference the equilibrium diagram Fe—Fe3C, as shown in FIG. 10.

Said range confirms the HPI hypoeutectic tendency that, nonetheless, keeps good machinability parameters by the increased number of eutectic cells. Also, in order to enable the obtainment of pearlite refinement, this method prescribes that the shake-out operation be done when the cast superficial temperature range is between 400° C. and 680° C., according to the cast wall thickness variation.

Said method produces some remarkable material property differences in the final microstructure, when compared with traditional gray iron. On the metallurgical diagram data, FIG. 9, said differences are clear when the HPI input data are considered. The thick line in FIG. 9 represents such HPI input data on the diagram, where the corresponding output data are defined considering the traditional gray iron results.

Figure 9:
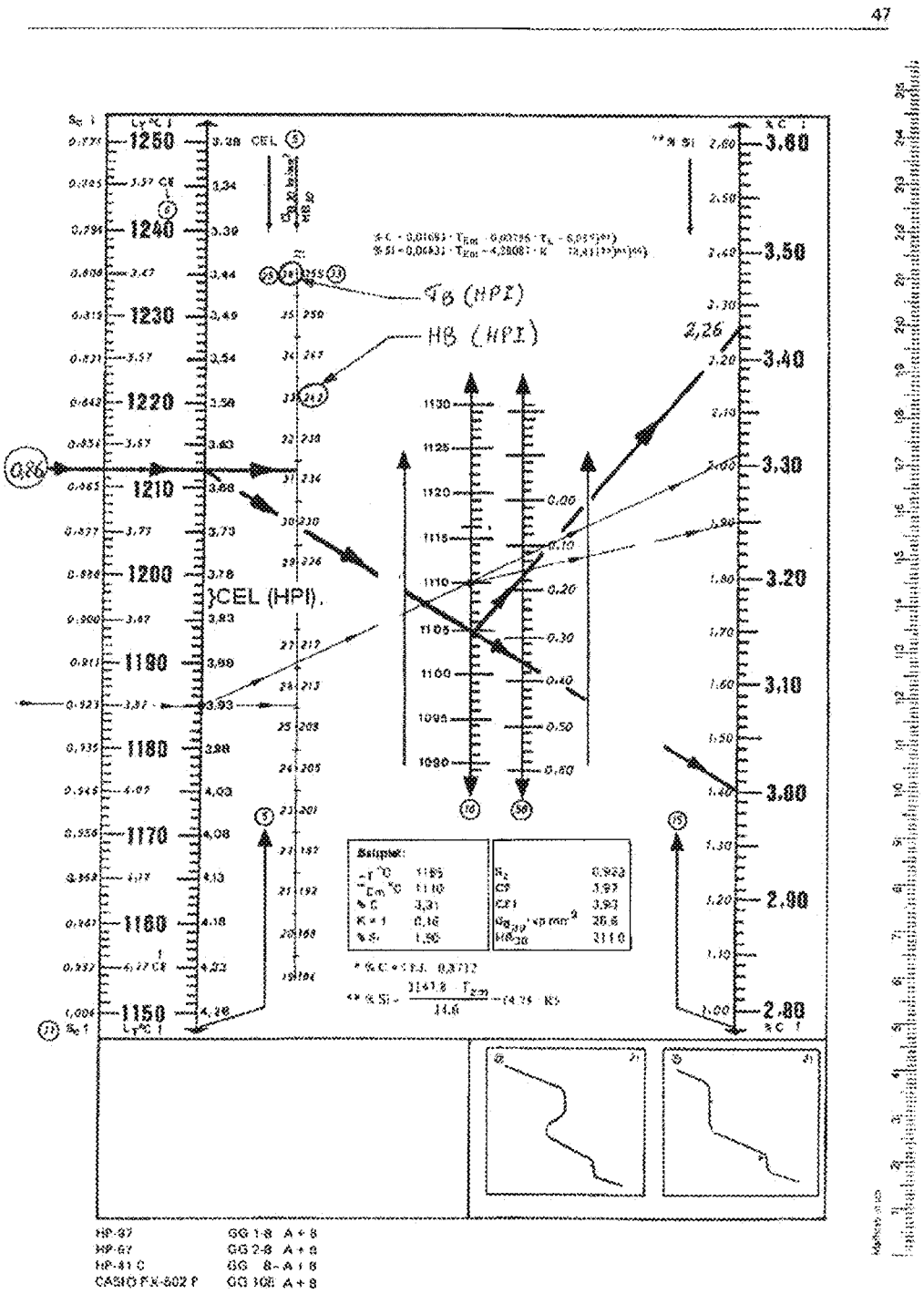
FIG. 9 shows a metallurgical nomogram for traditional gray irons, taken from the German book "Technology and quality standards for evaluation of cast iron with lamellar graphite", author Erich Pirweck, ed. Fredr. Vieweg & Son, Wiesbaden. The hatch line with arrow shows the parameters and properties for common gray irons. The thick line with arrow (manually added) shows that the HPI actual tensile strength (σB(HPI)=36 Kg/mm2) overcome the foreseen in the nomogram (σB=30 Kg/mm2). On the other hand, the HPI Brinell hardness (HB(HPI)≈240) is lower than foreseen in the nomogram(HB≈255) for a gray iron with tensile about 36 Kg/mm2. The input data Sc=0.86 (carbon saturation of the HPI alloy) was obtained by the formula Sc=% C/[4.3−1/3(% Si+% P)]

Taking the diagram in FIG. 9 (developed from traditional gray iron alloys), one can visualize such remarkable differences between HPI and normal gray iron properties. As an example, considering the Diesel 6 cylinder block cast by HPI method, the found input data are: "SC=0.86" (carbon saturation); TL=1210° C. (Liquidus Temperature) and C=3.0% (Carbon content).

Remarks:

When the thick line crosses the tensile scale, the theoretical gray iron should present the uncommon value of ≈30 Kg/mm2. Instead, the HPI prototype presented the real value of 36 Kg/mm2. If we consider that a typical market gray iron hardly reaches above 28 Kg/mm2 (for cylinder blocks or heads), it is easy to observe here the first difference between both alloys.

Observing now the hardness scale on FIG. 9 diagram, we can see that if such theoretical gray iron alloy presents the tensile value ≈35 Kg/mm2, the related hardness value should be ≈250 HB. However, the HPI prototype cyl. block with the real tensile value of 36 Kg/mm2, presented the hardness value ≈240 HB. In other words, even presenting the same or higher tensile value, the HPI alloy has a clear tendency to have lower hardness if compared with a theoretical gray iron alloy with the same tensile value.

If we still take the same theoretical gray iron with the tensile value ≈35 Kg/mm2, the related carbon equivalent value (CEL) on FIG. 9 diagram presents the very low value of ≈3.49%. Instead, the HPI cyl. block prototype with 36 Kg/mm2 has CEL=3.80%, which means that, keeping the same tensile value for both alloys, the HPI alloy has a remarkable low shrinkage tendency.

The remarks above explain why we do not find on the market high resistance traditional gray iron to be used in cylinder blocks or heads; If such alloy were applied, it would present serious machinability and soundness problems (similar to CGI alloy). The purpose of the HPI alloy is exactly to fulfill such technical need.

Technical Data Comparisons Among Gray Iron Alloy (GI), HPI Alloy and CGI Alloy

Some ranges of mechanical and physical properties taken from commercial casts were followed to compare traditional gray iron (GI); high performance iron (HPI) and compact graphite iron (CGI):

Properties of traditional gray iron versus high performance iron

| | GI | HPI | CGI |
|---|---|---|---|
| Heat Transfer Rate (W/m ° K): | ≈50 | ≈50 | ≈35 |
| Hardness (HB) | 200 up to 250 | 230 up to 250 | 207 up to 255 |
| Tensile Strength (Mpa) | 180 up to 270 | 300 up to 370 | 300 up to 450 |
| Fatigue Strength (Mpa): By Rotating Banding | ≈100 | ≈180 | ≈200 |
| Thermal Fatigue (Cycles): Temperature Range 50° C.-600° C. | $10.5 \times 10^3$ | $20 \times 10^3$ | $23 \times 10^3$ |
| Machinability (Km): Milling By Ceramic Tool At 400 m/Min Speed | 12 | 10 | 6 |
| Micro Structure | pearlite-ferrite; graph. A, 2/5 | pearlite 100%; graph A, 4/7 | pearlite 100%; compact graph. 80%; ductile graphite 20% |
| Shrinkage Tendency (%) | 1.0 | 1.5 | 3.0 |
| Damping Factor (%): | 100 | 100 | 50 |
| Poisson's Rate: At Room Temperature | 0.26 | 0.26 | 0.26 |

According to the tests above, besides high tensile strength, the HPI alloy presents excellent machinability, damping vibration, thermal conductivity, low shrink tendency and microstructure stability (compatible with gray iron alloys).

The invention claimed is:

1. A method to obtain a gray iron alloy, in an induction furnace, wherein the method comprising:

a) deoxidizing of a liquid metal in a furnace by:

increasing the furnace temperature inside a range of 1370° C.-1400° C., the silicon dioxide (SiO2) equilibrium temperature;

turning off power to the furnace about for at least 5 minutes in order to promote flotation of coalesced oxides and other impurities;

spreading an agglutinating agent on the surface of the liquid metal then removing said agglutinant material, now saturated with coalesced oxides from the liquid metal, leaving a cleaner liquid metal inside the furnace;

b) by pre-nucleating:

pouring from 15% to 30% of the liquid metal on a specific ladle;

during operation, inoculating from 0.45% to 0.60% in % weight of a granulated inoculant of Fe—Si—Sr or Fe—Si—Ba—La alloys, right on a stream of the liquid metal;

pouring back over inoculated liquid metal from the ladle to the furnace, in order to mix over inoculated metal from the ladle with the uninoculated metal remained into the furnace; wherein during this last operation, the furnace must be kept on "turn on" phase; and from thermal analysis, the product of pre-nucleating has two thermal parameters from the cooling curves with:

a eutectic under cooling temperature, TSE, greater than or equal to 1115° C. and a range of eutectic recalescence, ΔT, with a maximum of 6° C., wherein TSE and ΔT are two thermal parameters from the cooling curves during solidification;

during pouring an allowed temperature for HPI casts (Tp) is +/−10° C., in order to obtain a global cast modulus inside a range between 1.38 and 1.52; and the eutectoidic phase, the HPI microstructure presents graphite content on its matrix ≤2.3%, calculated by lever rule taking as reference the equilibrium diagram Fe—Fe3C.

* * * * *